US007536973B2

(12) United States Patent
Mettler et al.

(10) Patent No.: US 7,536,973 B2
(45) Date of Patent: May 26, 2009

(54) PLASTIC BLOW MOLDED BOARD-LIKE MEMBERS

(75) Inventors: Charles M. Mettler, Perry, OH (US); Gregory H. Brown, Stow, OH (US)

(73) Assignee: Plastic Safety Systems, Inc., Cleveland, OH (US)

( * ) Notice: Subject to any disclaimer, the term of this patent is extended or adjusted under 35 U.S.C. 154(b) by 854 days.

(21) Appl. No.: 11/031,408

(22) Filed: Jan. 7, 2005

(65) Prior Publication Data

US 2006/0150569 A1 Jul. 13, 2006

(51) Int. Cl.
*E01F 9/012* (2006.01)

(52) U.S. Cl. ..... 116/63 P; 116/63 R; 404/6; 404/9

(58) Field of Classification Search ..... 116/63 P, 116/63 R, DIG. 16; 404/6, 9, 10; 256/DIG. 4, 256/DIG. 6, 64, 19, 13.1
See application file for complete search history.

(56) References Cited

U.S. PATENT DOCUMENTS 3,032,371 A * 5/1962 Berridge et al. ..... 296/97.11
3,089,682 A * 5/1963 Parker ..... 256/64
3,242,245 A * 3/1966 Greig et al. ..... 264/545
3,380,428 A 4/1968 Abrams
3,796,168 A * 3/1974 Zeller ..... 105/377.05
3,799,507 A * 3/1974 Rizzo ..... 256/64
4,071,224 A * 1/1978 Gilbert ..... 256/64
4,231,676 A * 11/1980 Smith et al. ..... 404/6
4,298,186 A * 11/1981 Glass ..... 256/64
4,353,591 A * 10/1982 Cziptschirsch ..... 296/97.1
4,943,035 A * 7/1990 Thomson et al. ..... 256/64
5,030,029 A * 7/1991 Johnsen ..... 404/6
5,458,434 A * 10/1995 Bent et al. ..... 404/6
5,544,614 A * 8/1996 Cushman ..... 116/63 P
5,762,444 A * 6/1998 Giannelli ..... 404/9
5,857,729 A * 1/1999 Bogard ..... 296/100.09
5,860,386 A 1/1999 Schwab et al.
6,237,895 B1 * 5/2001 Thurston ..... 256/13.1
6,491,346 B1 * 12/2002 Gupta et al. ..... 297/452.65
6,561,120 B1 * 5/2003 Glass et al. ..... 116/63 P
6,659,681 B1 12/2003 Kulp et al.
6,826,887 B2 * 12/2004 Skov ..... 52/793.1
7,300,102 B2 * 11/2007 Gupta et al. ..... 296/208
2002/0000545 A1 * 1/2002 Pettit et al. ..... 256/19

OTHER PUBLICATIONS

PST-III Assembly & Parts list, copyright 1999 (enclosed).

Type III Barricade brochure (2 pages) dated Dec. 20, 2000 (enclosed).

(Continued)

*Primary Examiner*—R. A. Smith
*Assistant Examiner*—Amy Cohen Johnson
(74) *Attorney, Agent, or Firm*—Renner, Otto, Boisselle & Sklar, LLP

(57) ABSTRACT

Plastic blow molded board-like members include a plurality of longitudinally extending, laterally spaced aligned channels/grooves in opposite sides of the members. Each of the channels has closely spaced apart side walls and inner end walls. The inner end walls of aligned channels in opposite sides of the member are joined together to provide a relatively high strength reinforced core. The ends of the members are completely closed during the blow molding process for increased strength and to keep out dirt and moisture.

19 Claims, 4 Drawing Sheets

OTHER PUBLICATIONS

Rad-Tec Rubber Products brochure (5 pages) dated Dec. 13, 2002 (enclosed).

Bent Manufacturing, Type I & II Waffle Board Plastic Panel Barricades product literature (2 pages) dated Dec. 20, 2000 (enclosed).

* cited by examiner

PLASTIC BLOW MOLDED BOARD-LIKE MEMBERS

FIELD OF THE INVENTION

This invention relates to plastic board-like members that are blow molded to provide high strength, lightweight members for use in different applications including as barricade boards and the like.

BACKGROUND OF THE INVENTION

It is generally known to extrude boards out of plastic for use in various applications including barricade boards used on construction sites and the like. It is also generally known to provide such boards with reinforced cores for added strength.

However, the walls of conventional extruded plastic boards must be made relatively thick to provide the requisite strength for these and other applications, which adds to the weight and cost of the boards. Also the ends of conventional extruded boards are left open unless covered with a separately molded cap, which adds to the cost of the boards. Providing boards with closed ends has the advantage of increased strength as well as keeping out dirt and moisture.

SUMMARY OF THE INVENTION

The board-like members of the present invention are blow molded to include relatively high strength reinforced cores that permit the wall thickness of the members to be made less than conventional extruded boards and still have substantially the same strength and stiffness as conventional extruded boards having the same width and overall thickness. The cores are formed by molding a plurality of longitudinally extending, laterally spaced aligned channels or grooves in oppositely facing sides of the members and joining the inner end walls of the aligned channels/grooves together during the blow molding process.

The channels may be wavy along their length for increased strength. Also the channels may be spaced from the side edges of the members and terminate short of the ends of the members to provide an uninterrupted surface area around the entire periphery of the sides to aid in adhering reflective sheeting to one or both sides of the members.

Hardware holes may be molded completely through the members from one side to the other for added strength and ease of hardware installation. The channels are interrupted where the hardware holes are molded through the members.

The ends of the blow molded members may be completely closed during the blow molding process for increased strength and to keep out dirt and moisture.

These and other objects, advantages, features and aspects of the present invention will become apparent as the following description proceeds.

To the accomplishment of the foregoing and related ends, the invention, then, comprises the features hereinafter more fully described and particularly pointed out in the claims, the following description and the annexed drawings setting forth in detail a certain illustrative embodiment of the invention, this being indicative, however, of but one of the various ways in which the principles of the invention may be employed.

BRIEF DESCRIPTION OF THE DRAWINGS

In the annexed drawings:

FIG. 3 is an enlarged perspective view showing a plurality of plastic blow molded members of the present invention used as barrier boards in a traffic barricade or the like.

DETAILED DESCRIPTION OF THE INVENTION

Figure 1:
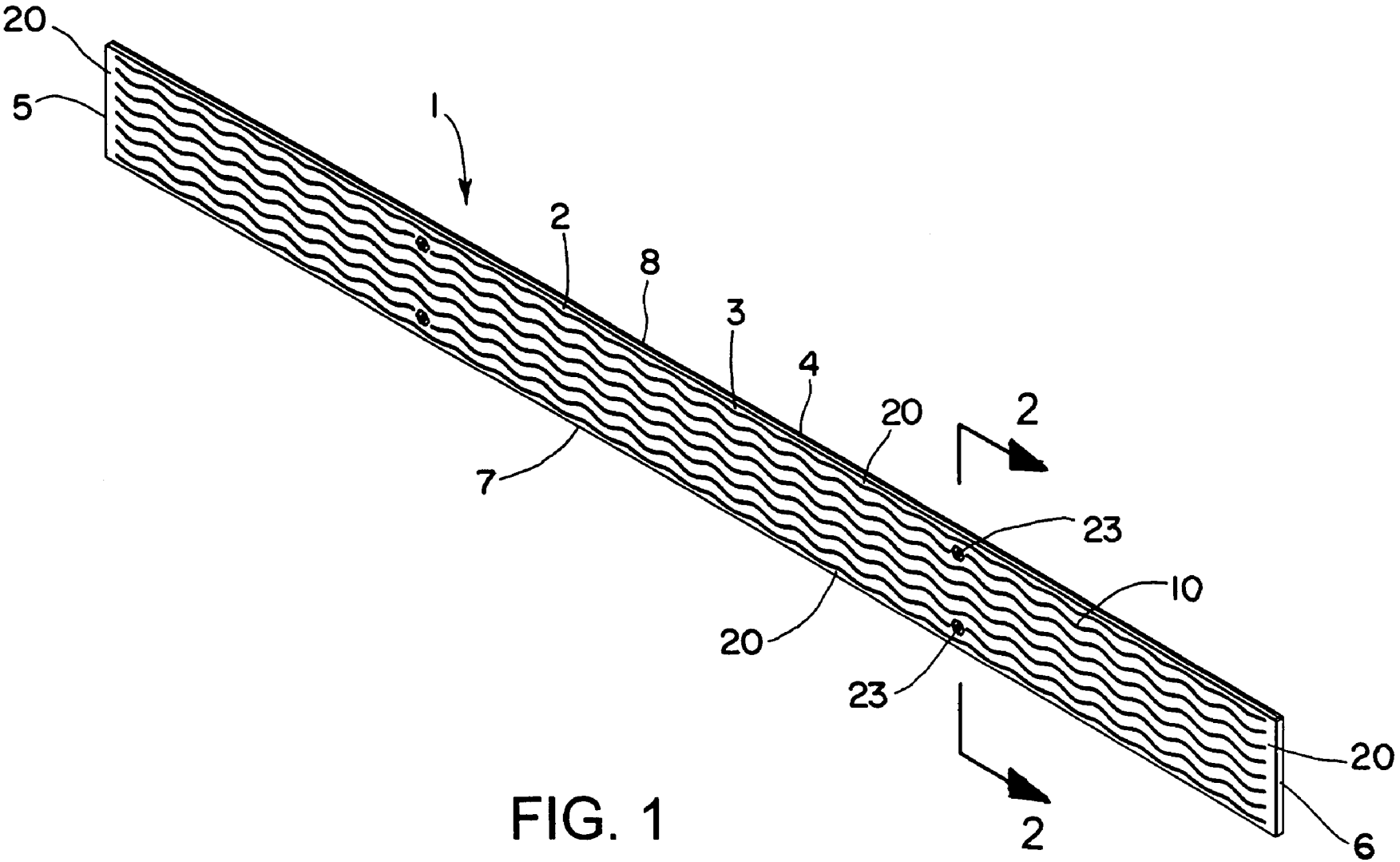
FIG. 1 is a perspective view of one form of plastic blow molded member in accordance with the present invention.
Figure 2:
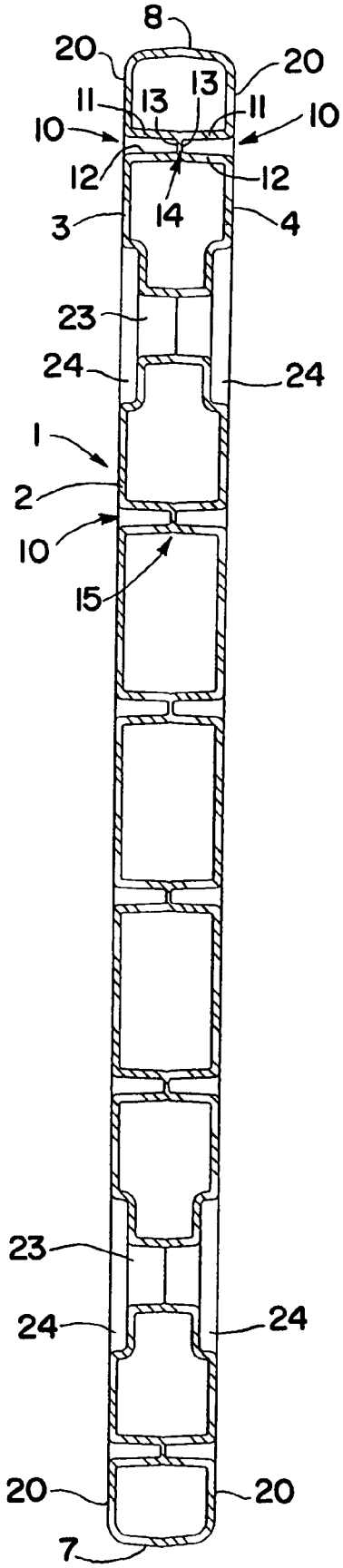
FIG. 2 is an enlarged transverse cross section through the member of FIG. 1, taken generally along the plane of the line 2-2 thereof.

Referring now in detail to the drawings, and initially to FIGS. 1 and 2, there is shown one form of plastic board-like member 1 of the present invention in the shape of an elongated plastic blow molded member 2 having spaced apart, oppositely facing sides 3, 4, ends 5, 6 and side edges 7, 8. Each member 2 has a greater length and width than thickness and may be blow molded out of any suitable plastic material such as high strength U.V. stabilized polyethylene. During the blow molding process, the ends 5, 6 of the members are completely closed for increased strength and to keep out dirt and moisture. Also during the blow molding process, a plurality of laterally spaced, longitudinally extending aligned narrow channels or grooves 10 are formed in both sides 3, 4 of the members. As seen in FIG. 2, each of the channels 10 has a pair of closely spaced apart side walls 11, 12 and an inner end wall 13 that provide tack off zones 14 where the respective side walls of aligned channels in opposite sides of the members are joined together during the molding process to provide the members with a high strength reinforced core 15.

Figure 3:
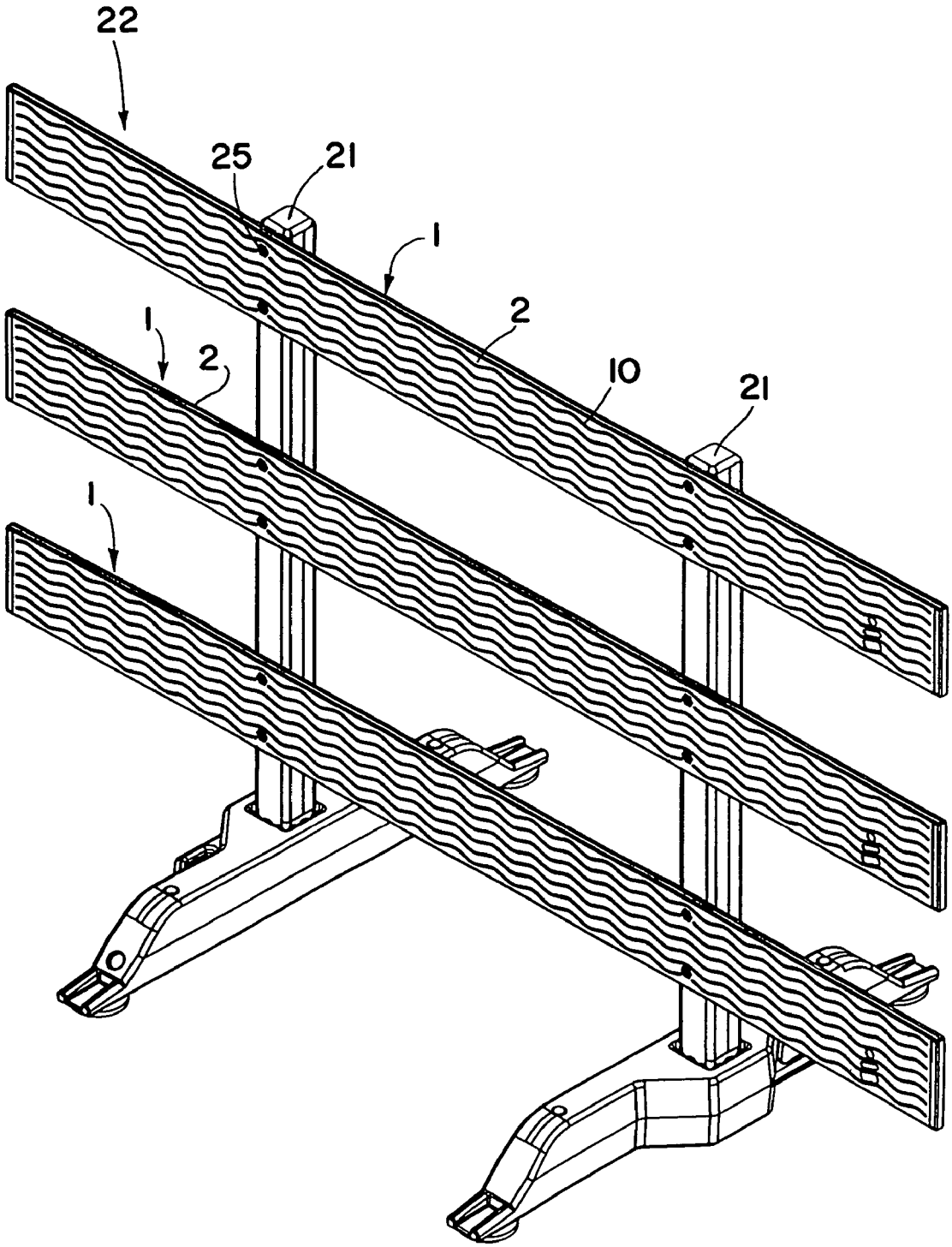

Channels 10 may extend over substantially the entire length of members 2 as shown in FIGS. 1 and 3. However, these channels may be spaced from the side edges 7, 8 and may terminate short of the ends 5, 6 of the members a sufficient distance to provide an uninterrupted surface area 20 around the entire periphery of both sides. For example, the uninterrupted surface area 20 may be approximately one-half inch to one inch wide along the side edges 7, 8 and at the ends 5, 6 of the members. This is particularly advantageous to insure proper adhesion if reflective sheeting (not shown) is applied to one or both sides of the members as when the members are used as barricade boards or the like. In applications where reflective sheeting may be applied to the boards, the channels 10 may be as narrow as practicable, for example, approximately ⅛ inch wide, to increase the surface area of the sides to provide greater support for the reflective sheeting.

Channels 10 are also desirably wavy along substantially their entire length to provide increased strength against bending of the members in both the length and width directions. Another advantage in providing the members with channels extending over substantially their entire length is that the channels provide room for expansion and contraction of the sides of the members during extreme ambient temperature changes to minimize warpage of the members due to temperature changes.

Figure 4:
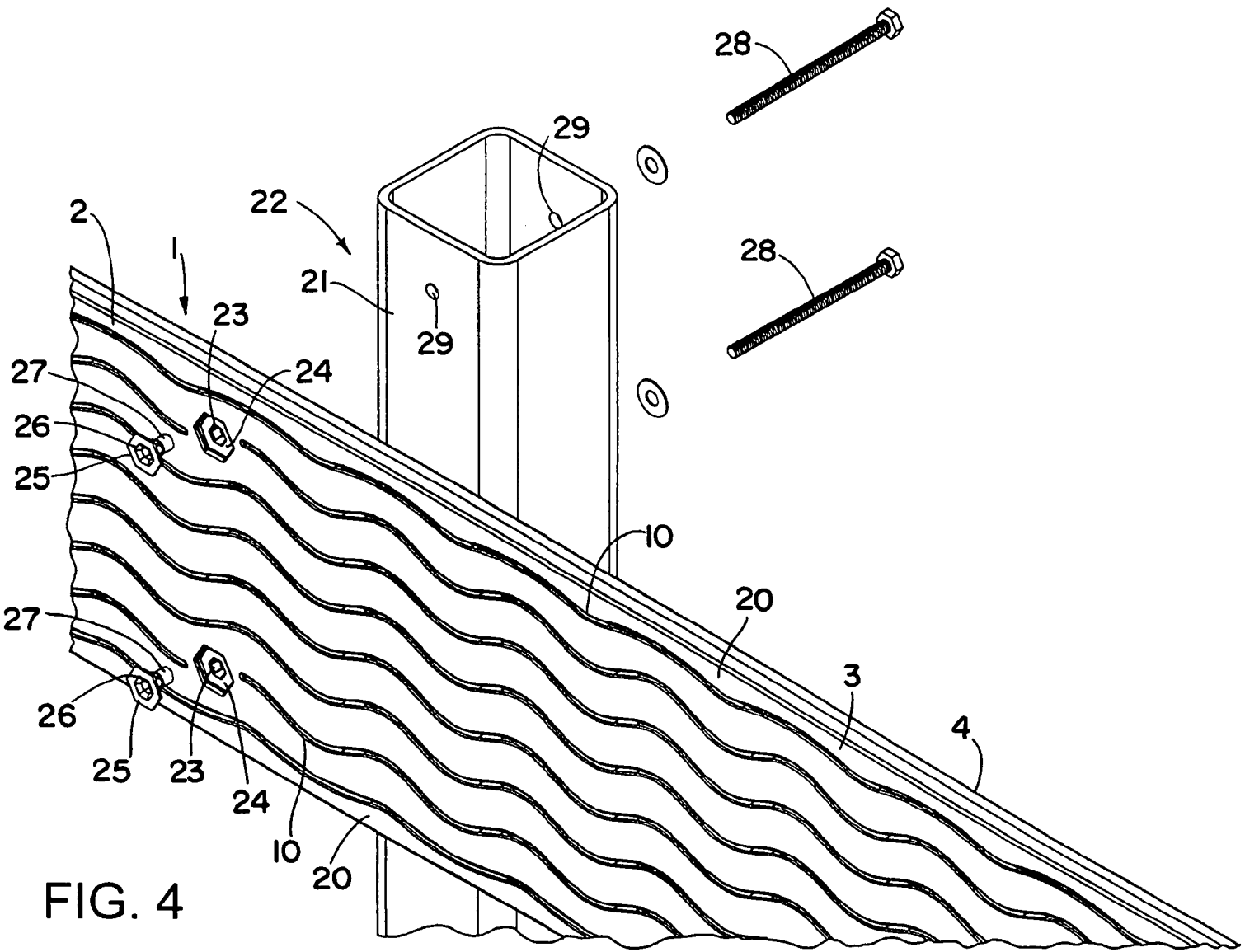
FIG. 4 is an enlarged exploded fragmentary perspective view of a portion of one of the plastic blow molded members and upright posts of the traffic barrier of FIG. 3 showing one type of hardware that may be used to attach the members to the posts.

To facilitate mounting of one or more of the members 2 to a post or other structural support, for example, to vertical uprights or posts 21 of a traffic barricade 22 as shown in FIGS. 3 and 4, hardware holes 23 may be molded completely through the members from one side to the other as shown in FIG. 2 in areas where the channels 10 are interrupted for added strength and ease of hardware installation. Enlarged recesses 24 may be provided at both ends of the holes 23 for flush mounting of correspondingly shaped fastener heads to protect the sheeting on other members from being scratched by the fasteners.

For example, a pallet nut 25 having a hex head 26 may be received in a correspondingly shaped hex recess 24 in the ends of the mounting holes 23 as shown in FIG. 4. Also the recesses 24 may be a little oversized relative to the pallet nut heads to accommodate the sheeting when the shafts 27 of the pallet nuts are pushed through the sheeting and the pallet nut heads are received in the recesses. Then long bolts 28 may be inserted through predrilled holes 29 in the uprights 21 and threaded into the internally threaded shafts of the pallet nuts. The non-circular shape of the recesses in the ends of the mounting holes will prevent the pallet nuts from spinning during tightening of the bolts.

The number of channels 10 in a given member 2 and tack off zones 14 produced thereby may be varied as desired. For example, for members having a width of approximately 8¼ inches and a thickness of approximately 0.8 inch, seven substantially uniformly spaced channels may be provided in both surfaces of the members. Also the members may be blow molded in any length desired, for example, in lengths of 4 feet, 6 feet, and 8 feet. Also if desired boards of greater lengths, for example, 10 feet and 12 feet lengths, may be blow molded depending on the size of the blow molding apparatus that is available. The number and location of hardware holes in the members may also be varied as desired depending on the application. For example, for barricade board applications, typically two sets of hardware holes are provided in each member, each set spaced approximately 44 inches apart.

Because of the increased strength of the reinforced cores of the blow molded members of the present invention, the walls of the members may be made thinner than the walls of conventional plastic extruded boards to reduce the weight/linear foot of the members by as much as 25% without sacrificing strength. For example, the sides of a conventional extruded board that is approximately 8¼ inches wide and 0.8 inch thick may have a wall thickness of between approximately 0.065 inch and 0.070 inch, whereas the sides of an equivalent blow molded member of the present invention having substantially the same strength and stiffness may have a wall thickness of between approximately 0.045 inch and 0.055 inch, and the side walls of the channels may have a wall thickness of between approximately 0.030 inch and 0.040 inch.

From the foregoing, it will be apparent that the blow molded members of the present invention have a relatively high strength reinforced core that permits a lesser wall thickness to be used than the wall thickness of conventional extruded boards for reduced weight and still obtain substantially the same strength and stiffness. Also the ends of the blow molded members of the present invention are completely closed during the blow molding process for increased strength as well as keeping out dirt and moisture.

Although the invention has been shown and described with respect to a certain embodiment, it is obvious that equivalent alterations and modifications will occur to others skilled in the art upon the reading and understanding of the specification. In particular, with regard to various functions performed by the above described components, the terms (including any reference to a "means") used to describe such components are intended to correspond, unless otherwise indicated, to any component which performs the specified function of the described component (e.g., that is functionally equivalent), even though not structurally equivalent to the disclosed component which performs the function in the herein exemplary embodiment of the invention. In addition, while a particular feature of the invention may have been disclosed with respect to only one embodiment, such feature may be combined with one or more other features of other embodiments as may be desired and advantageous for any given or particular application.

What is claimed is:

1. A high strength, lightweight plastic board-like member comprising an elongated plastic blow molded member having spaced apart oppositely facing sides and ends and side edges, and a plurality of longitudinally extending, laterally spaced channels in each of the sides, each of the channels having closely spaced apart side walls and inner end walls, at least some of the channels in one of the sides being aligned with some of the channels in the other side and joined together at the inner end walls of the respective channels to provide a relatively high strength reinforced core, wherein the channels are wavy along their length for increased strength.

2. The member of claim 1 wherein the channels extend substantially the entire length of the member.

3. The member of claim 2 wherein the channels are spaced from the side edges and terminate short of the ends to provide an uninterrupted surface area around the entire periphery of the sides.

4. The member of claim 1 wherein the ends of the member are completely closed during the blow molding process for increased strength and to keep out dirt and moisture.

5. The member of claim 1 further comprising hardware holes molded completely through the member from one side to the other side for added strength and ease of hardware installation, the channels being interrupted where the hardware holes are molded through the member.

6. A high strength, lightweight plastic board-like member comprising an elongated plastic blow molded member having spaced apart oppositely facing sides and ends and side edges, and a plurality of longitudinally extending, laterally spaced channels in each of the sides, each of the channels having closely spaced apart side walls and inner end walls, at least some of the channels in one of the sides being aligned with some of the channels in the other side and joined together at the inner end walls of the respective channels to provide a relatively high strength reinforced core, and hardware holes molded completely through the member from one side to the other side for added strength and ease of hardware installation, the channels being interrupted where the hardware holes are molded through the member.

7. The member of claim 6 wherein the hardware holes have enlarged recesses at both ends for flush mounting of hardware in either of the ends.

8. The member of claim 7 wherein the enlarged recesses at the ends of the hardware holes have a non-circular shape for preventing rotation of correspondingly shaped hardware heads in the recesses.

9. A plastic barricade board comprising an elongated plastic blow molded member having spaced apart oppositely facing sides and ends and side edges, and a plurality of longitudinally extending, laterally spaced aligned channels in each of the sides, each of the channels having closely spaced apart side walls and inner end walls, the inner end walls of the aligned channels in the respective sides being joined together during the blow molding process to provide the member with a relatively high strength reinforced core, the ends of the member being completely closed during the blow molding process for increased strength and to keep out dirt and moisture, wherein the channels are wavy along their length to provide increased strength against bending of the member.

10. The board of claim 9 wherein the channels extend substantially the full length of the member.

11. The board of claim 10 wherein the channels terminate short of the ends of the member and are spaced from the side edges of the member to provide an uninterrupted surface area around the entire periphery of the sides to aid in adhering reflective sheeting to one or both sides of the member.

12. The board of claim 11 wherein the uninterrupted surface area is between approximately one-half inch and one inch wide around the entire perimeter of the sides.

13. A plastic barricade board comprising an elongated plastic blow molded member having spaced apart oppositely facing sides and ends and side edges, and a plurality of longitudinally extending, laterally spaced aligned channels in each of the sides, each of the channels having closely spaced apart side walls and inner end walls, the inner end walls of the aligned channels in the respective sides being joined together during the blow molding process to provide the member with a relatively high strength reinforced core, the ends of the member being completely closed during the blow molding process for increased strength and to keep out dirt and moisture, and hardware holes molded completely through the member from one side to the other side for added strength and ease of hardware installation, the channels being interrupted where the hardware holes are molded through the member.

14. The board of claim 13 wherein the member has a width of approximately 8¼ inches and a thickness of approximately 0.8 inch, and the sides have a wall thickness of between approximately .045 inches and .055 inches.

15. The board of claim 14 wherein the side walls of the channels have a wall thickness of between approximately .030 inches and .040 inches.

16. The board of claim 13 wherein the member is blow molded out of polyethylene.

17. The board of claim 13 wherein the hardware holes have enlarged recesses at both ends for flush mounting of hardware in either end.

18. The board of claim 17 wherein the enlarged recesses have a non-circular shape for nonrotatable flush mounting of correspondingly shaped hardware heads in the recesses.

19. The board of claim 13 wherein two sets of longitudinally spaced apart hardware holes are molded completely through the member.

* * * * *